US012590771B2

(12) United States Patent
Baert et al.

(10) Patent No.: US 12,590,771 B2
(45) Date of Patent: Mar. 31, 2026

(54) LARGE-CALIBER GUN HAVING A BREECH ASSEMBLY WITH MULTIPLE CHAMBERS

(71) Applicant: KNDS FRANCE, Versailles (FR)

(72) Inventors: Steve Baert, Bourges (FR); Frédéric Hubschwerlen, Bourges (FR); Marc Gauci, Bourges (FR)

(73) Assignee: KNDS FRANCE, Versailles (FR)

( * ) Notice: Subject to any disclaimer, the term of this patent is extended or adjusted under 35 U.S.C. 154(b) by 0 days.

(21) Appl. No.: 18/875,420

(22) PCT Filed: May 19, 2023

(86) PCT No.: PCT/IB2023/055171

§ 371 (c)(1),
(2) Date: Dec. 16, 2024

(87) PCT Pub. No.: WO2023/242648

PCT Pub. Date: Dec. 21, 2023

(65) Prior Publication Data

US 2025/0369712 A1 Dec. 4, 2025

(30) Foreign Application Priority Data

Jun. 17, 2022 (FR) ..... 2205882

(51) Int. Cl.
*F41A 9/26* (2006.01)
*F41A 9/39* (2006.01)

(52) U.S. Cl.
CPC . *F41A 9/26* (2013.01); *F41A 9/39* (2013.01)

(58) Field of Classification Search
CPC ..... F41A 9/26; F41A 9/39
(Continued)

(56) References Cited

U.S. PATENT DOCUMENTS 2,717,534 A * 9/1955 Atherton, Jr. ..... F41A 9/27 89/1.814
2,830,499 A * 4/1958 Even ..... F41A 9/42 89/47

(Continued)

FOREIGN PATENT DOCUMENTS

EP 2383535 A1 * 11/2011 ..... F41A 9/26
GB 639 712 A 7/1950

OTHER PUBLICATIONS

Aug. 10, 2023 International Search Report issued in International Patent Application No. PCT/IB2023/055171.

(Continued)

*Primary Examiner* — John Cooper
(74) *Attorney, Agent, or Firm* — OLIFF PLC

(57) ABSTRACT

A large-calibre firearm including a breech assembly including a breech block rigidly connected to a firearm barrel, a breech support movable in axial translation relative to the breech block and coupled to a breech head, the assembly further includes a plurality of loading chambers, a mechanism for moving the chambers, configured to support the chambers and successively place one of the chambers in a firing position, and at least one other chamber in a supply position, in which the at least one chamber is able to receive ammunition via its rear end, and a locking mechanism configured to move the breech head and the chamber placed in the firing position between an unlocked position and a locked position, in which the chamber is closed off at its rear end by the breech head and opens out at its front end into the firearm barrel.

10 Claims, 5 Drawing Sheets

(58) Field of Classification Search
USPC ..... 89/33.02
See application file for complete search history.

(56) References Cited

U.S. PATENT DOCUMENTS

| | | | | | |
|---|---|---|---|---|---|
| 3,625,108 | A * | 12/1971 | Smith et al. | F41A 9/30 | 89/1.804 |
| 4,481,862 | A * | 11/1984 | Wiethoff | F41A 9/26 | 89/46 |
| 4,495,853 | A * | 1/1985 | Gottwaldt | F41A 9/26 | 89/34 |
| 5,111,732 | A * | 5/1992 | Marcon | F41A 9/27 | 89/135 |
| 5,341,721 | A * | 8/1994 | Kotai | F41A 9/26 | 89/46 |
| 2024/0302120 | A1 * | 9/2024 | Yu | F41A 9/70 | |

OTHER PUBLICATIONS

Aug. 10, 2023 Written Opinion of the International Searching Authority issued in International Patent Application No. PCT/IB2023/055171.

Jan. 12, 2023 Search Report and Written Opinion issued in French Patent Application No. 2205882.

* cited by examiner

[Fig. 1]
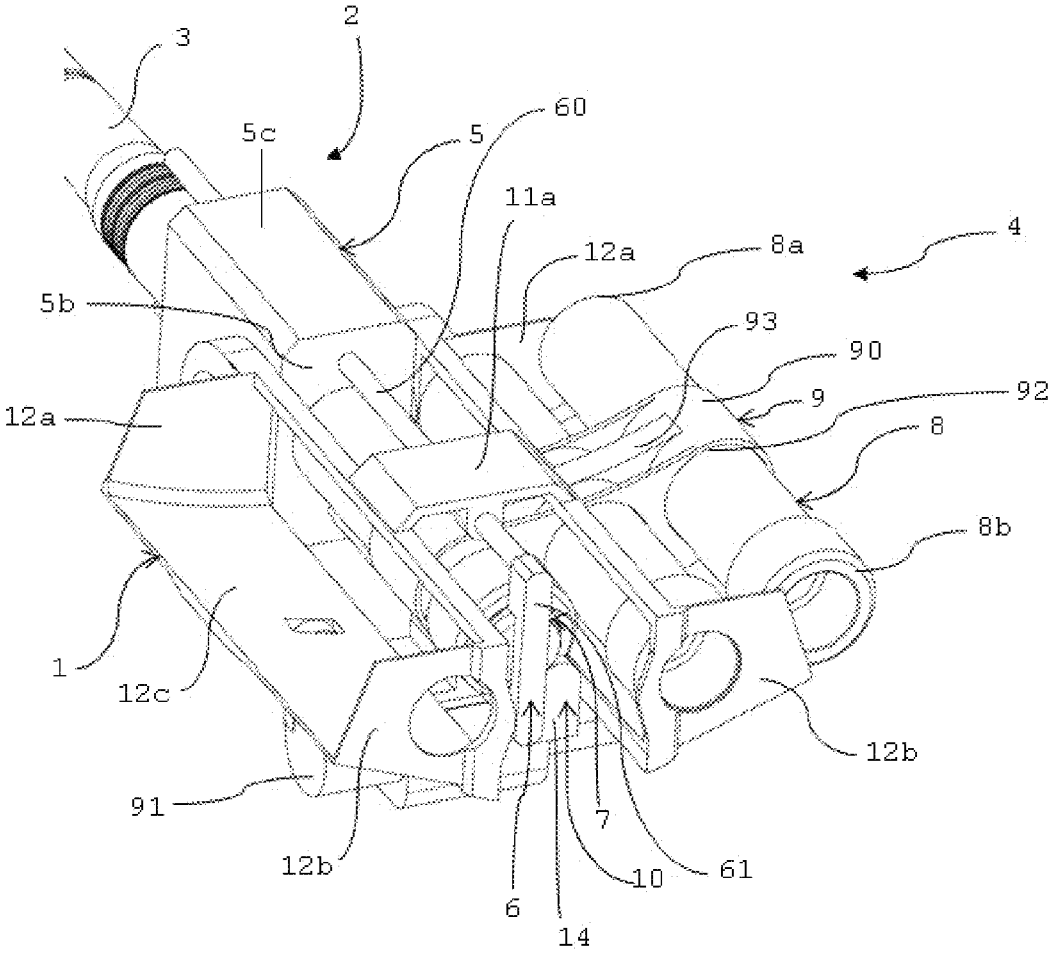

[Fig. 2]
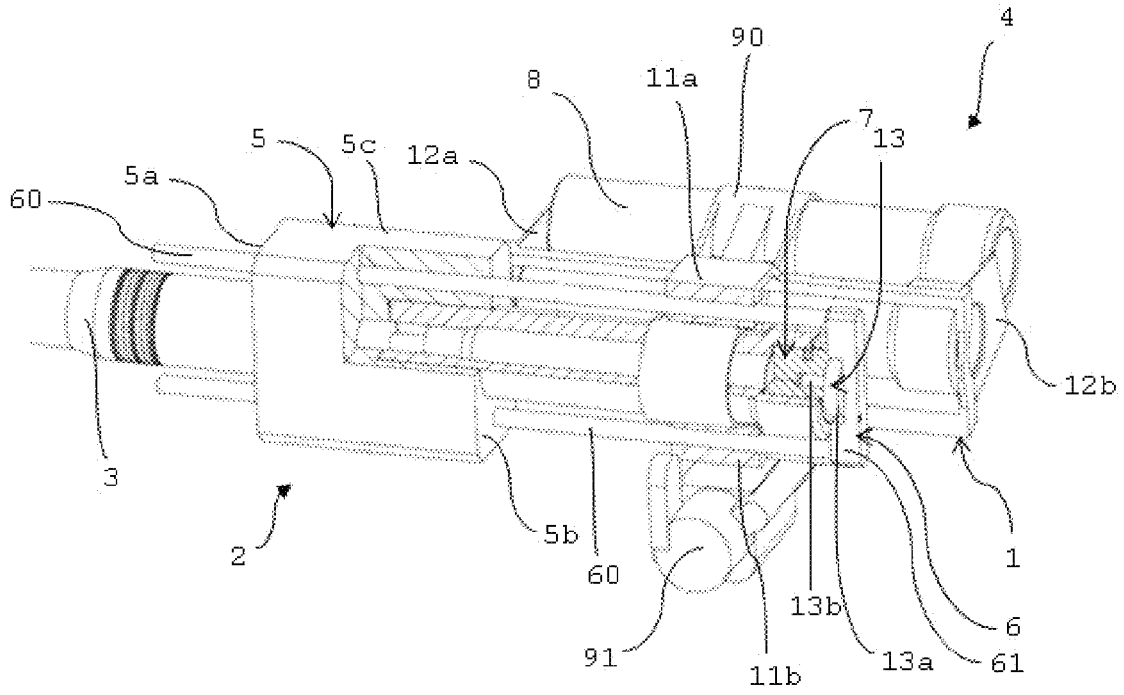
[Fig. 3]
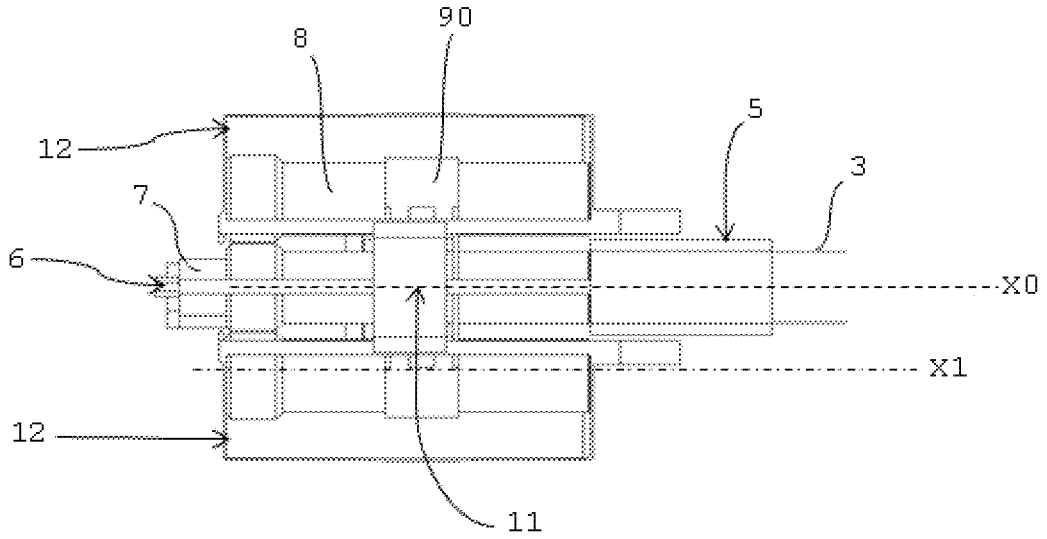

[Fig. 4]
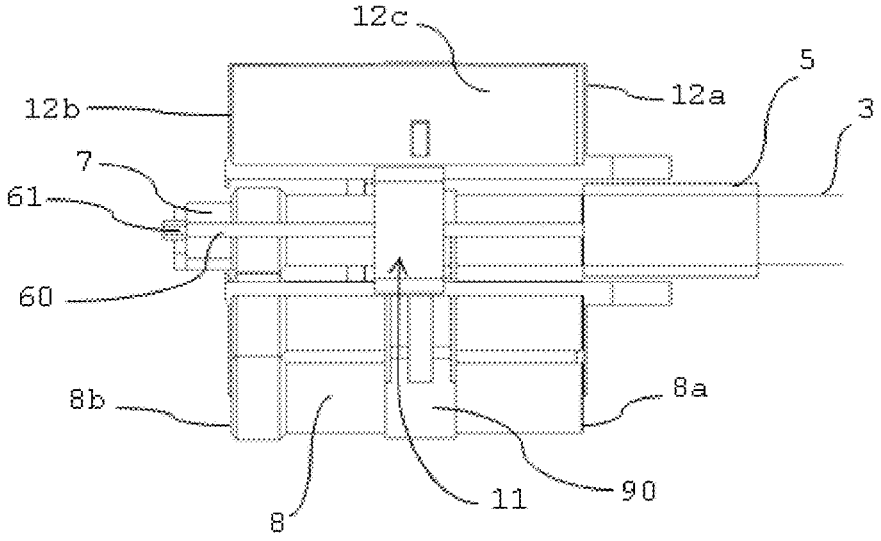
[Fig. 5]
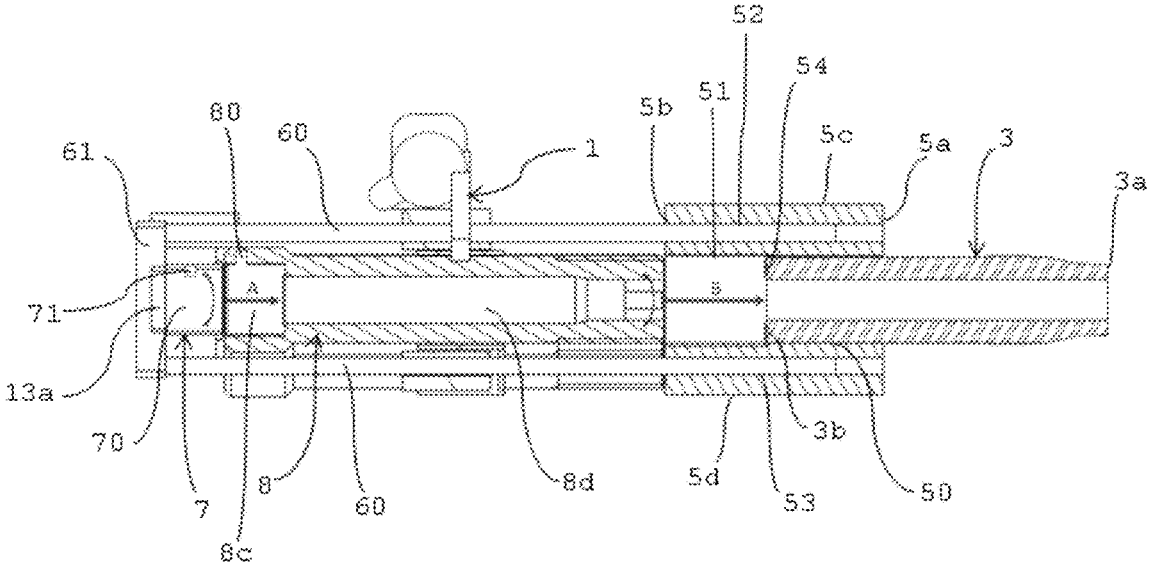

[Fig. 6]
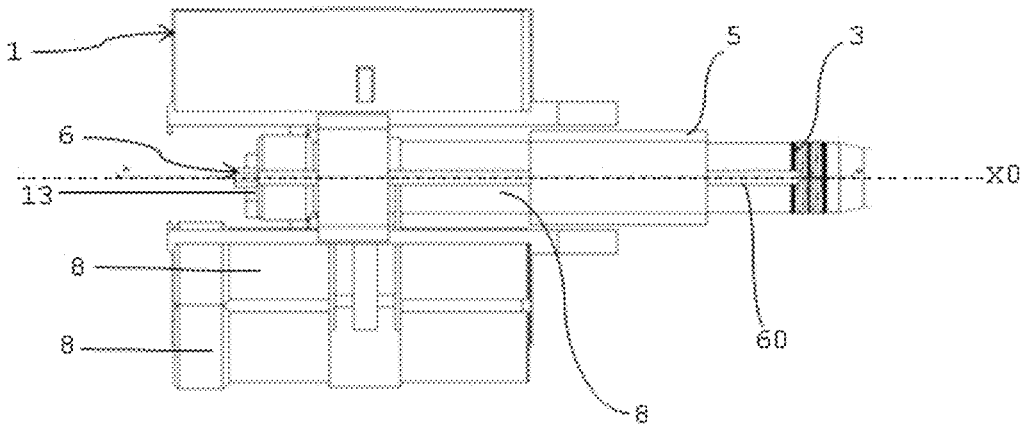
[Fig. 7]
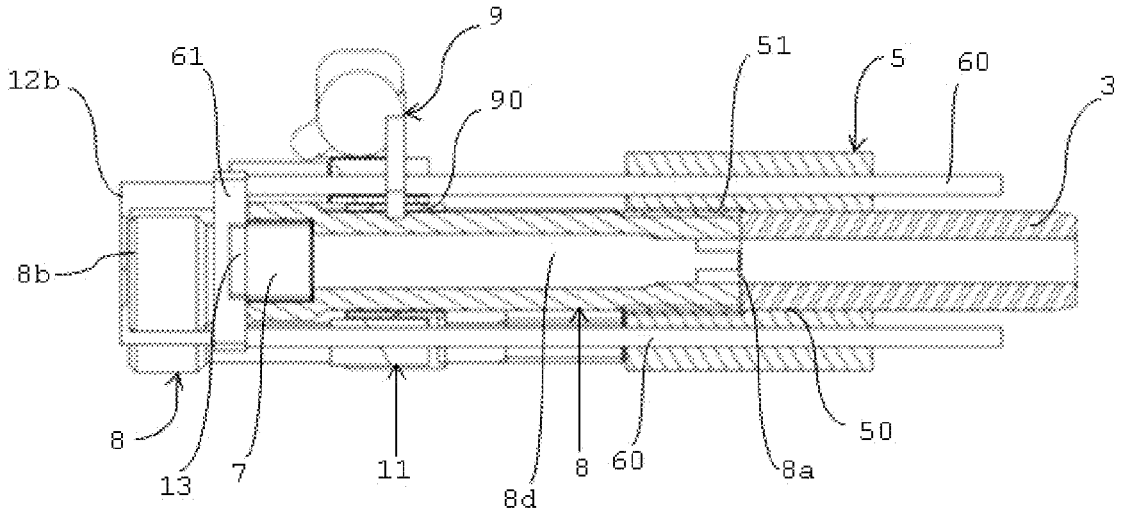

[Fig. 8]
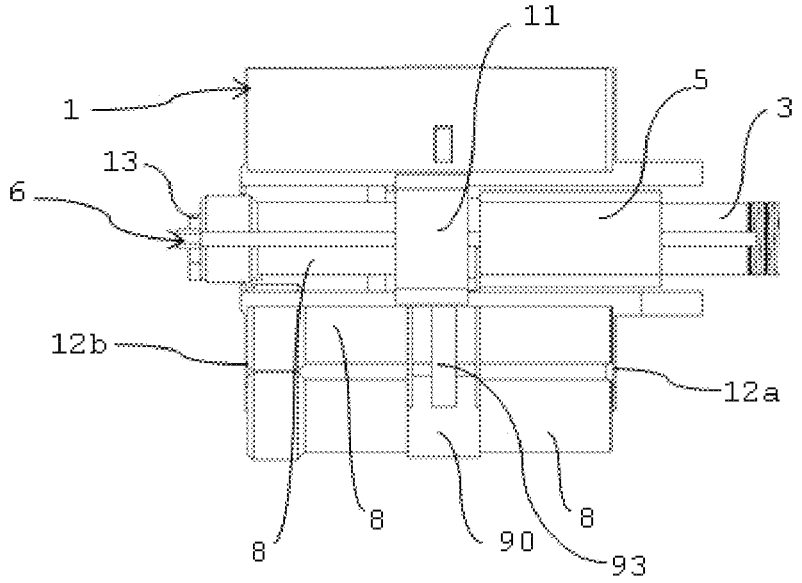
[Fig. 9]
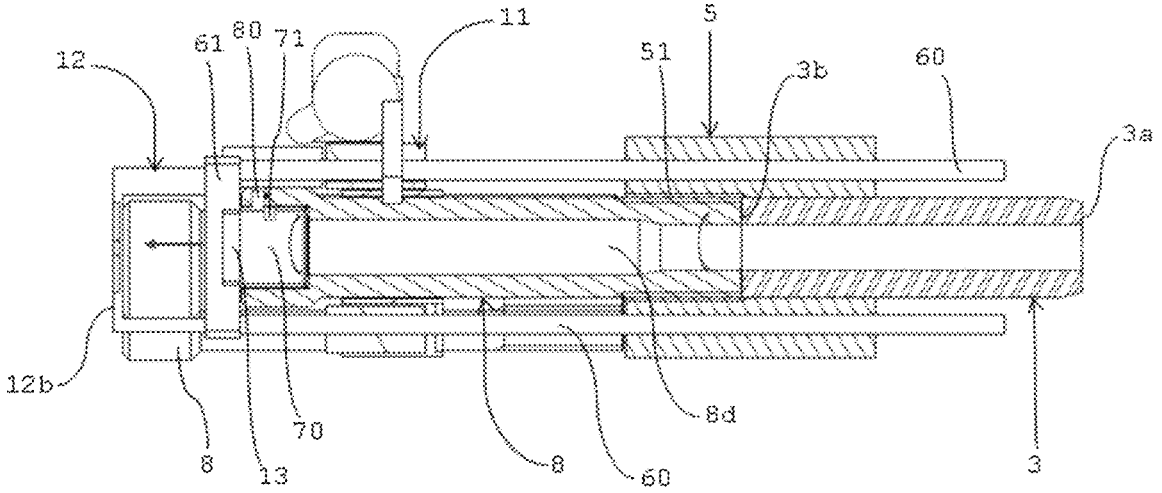

LARGE-CALIBER GUN HAVING A BREECH ASSEMBLY WITH MULTIPLE CHAMBERS

The technical field of the invention is that of large-caliber guns and in particular large-caliber rear-loading guns.

Typically, a large-caliber rear-loading gun includes a barrel mounted in a cradle, inside which it slides on slides during recoil, and a breechblock. A locking mechanism is provided at the rear of the breechblock. For example, this locking mechanism is a screw mechanism including a cap and a screw intended to screw into the chamber of the barrel.

However, with such a gun, the cycle of loading and firing several rounds of ammunition is not quick, and therefore does not allow a high rate of fire to be reached.

Yet, in order to be able to take on particularly elusive targets with a satisfactory hit probability, the gun must be able to fire, almost instantaneously, short bursts at a high rate of fire.

To increase the rate of fire, it is known to use a gun with drum.

Conventionally, a gun with drum includes, on the one hand, a barrel that is movable during firing relative to a support and, on the other hand, at least one ammunition drum with at least two chambers, one of which can be placed at a firing position and the other at a feeding position, by rotation of the drum.

U.S. Pat. No. 5,341,721 A discloses such a large-caliber gun with drum. In particular, this large-caliber gun includes two rotating drums mounted behind the breechblock of the gun. Each drum has housings for receiving ammunition. The gun further includes means for translating the ammunition, provided behind the drums and configured to push towards the barrel a round of ammunition that is contained in one of the housings of the drums and is aligned with the axis of the barrel.

Such a gun with drum minimizes the time taken for conveying rounds of ammunition between their storage location, in one of the housings of the drums, and the gun chamber where the ammunition is ignited and fired.

However, these drums are bulky and heavy, and are dedicated solely to storing and conveying the round of ammunition in front of the gun chamber. Chambering the round of ammunition involves means for positioning the round of ammunition, and then using means for closing and opening the breech of the gun. In addition, the drum(s) containing the ammunition must often be placed at a distance from the closed breech to allow the gun to recoil, which increases the size of the vehicle or turret carrying the gun and modifies its inertia. Finally, between each shot, the pointing of the gun in elevation must be brought back into alignment with the drum(s), which increases the duration of a doubled firing sequence.

The present invention thus aims to provide a solution for reducing the reloading time between several consecutive shots (redoubling) for a large-caliber gun, and thus to increase the rate of fire of a large-caliber gun. The present invention also aims to respond favorably to space-saving constraints, while enabling redoubling for any elevation of the barrel, and in particular for direct fire. The invention also makes it possible to choose which type of round ammunition will be fired on the next shot.

The solution according to the present invention is based on the presence of a plurality of chambers intended to contain large-caliber ammunition ready for firing, each chamber being movable between a position in which it can be reloaded and a position in alignment with the barrel and in which the chamber is closed at its rear end and opens out at its frond end into the barrel.

The present invention thus relates to a large-caliber gun including a cradle and a recoiling mass mounted so as to be movable relative to the cradle, the recoiling mass including a barrel having a longitudinal axis and a breech assembly, the breech assembly including a breechblock secured to the barrel, a breech support movable in axial translation relative to the breechblock and coupled to a breech head, characterized in that the breech assembly further includes a plurality of loading chambers each intended to receive a round of ammunition, a mechanism for moving the chambers configured to support the chambers and successively place one of the chambers in a firing position, namely between the breechblock and the breech head and in alignment with the longitudinal axis of the barrel, and at least one other chamber in a feeding position, in which the at least one chamber is able to receive a round of ammunition via its rear end, and a locking mechanism configured to move the breech head and the chamber placed in the firing position between an unlocked position and a locked position, in which the chamber is closed off at its rear end by the breech head and opens out at its frond end into the barrel, the locking mechanism being further configured to move both the breech head and the chamber placed in the firing position to the locked position by a movement of the breech head.

Thanks to such a breech assembly, it is possible to reload the empty chamber(s) in the feeding position while a chamber is locked with a round of ammunition ready for firing, and thus it is possible to increase responsiveness by reducing the time elapsing between several consecutive shots. It is also possible to place in the feeding position a chamber that has suffered a shot failure, and thus to handle a non-fired shot off the axis of the barrel, while having a chamber locked with a round of ammunition ready for firing, so that such an operation of handling a non-fired shot does not reduce responsiveness.

In addition, the breech assembly according to the present invention enables the round of ammunition to be positioned quickly, while at the same time having a compact structure.

The empty chambers can be reloaded manually. Alternatively, the empty chambers can be reloaded automatically or semi-automatically by means of a reloading system. In this case, the reloading system is preferably a double reloading system, to reduce reloading time.

The plurality of loading chambers can be loaded with a variety of ammunition. In this way, the presence of several chambers allows a choice among several ammunition.

In a particular embodiment, the mechanism for moving the chambers is supported by the cradle and includes a drawer able to mechanically support the plurality of chambers arranged side by side and parallel to the longitudinal axis, and a translation actuator connected to the drawer to move the drawer in translation relative to the cradle in a translation direction transverse to the longitudinal axis.

Such a movement mechanism, based on a simple translational movement, enables quick and easy movement of the chambers, and therefore quick selection of the round of ammunition ready for firing.

Preferably, the translation actuator is a motorized actuator including an electric or hydraulic motor, in particular a geared motor, coupled to the drawer by a rack-and-pinion linkage.

Such a translation actuator is easy to integrate, reliable and inexpensive.

Advantageously, the drawer includes a plurality of axial through housings, each axial through housing being shaped to receive a loading chamber with a clearance between the chamber and the housing, the cradle including axial translation stops, integral with the cradle, arranged to be in close proximity to the front and rear ends of each chamber placed in the feeding position and configured to leave the opening at the rear end of each chamber free.

This clearance allows the chamber placed in alignment with the longitudinal axis of the barrel to slide axially in the housing, in other words to be axially movable relative to the drawer and the cradle. Despite this clearance, the axial translation stops prevent chambers that are not aligned with the barrel from sliding in their housing, in other words the chambers in the feeding position are held in a fixed position relative to the drawer.

According to a particular embodiment, the breech head is a screw breech head having an external thread able to cooperate with a corresponding internal thread provided at the rear end of each chamber, each chamber having an external thread at its front end able to cooperate with a corresponding internal thread provided in the breechblock, the locking mechanism being a screw locking mechanism having a linear actuator connected to the breech support for linearly moving the breech support relative to the breechblock along the longitudinal axis, a rotary actuator connected to the breech head to rotate the breech head relative to the breech support about the longitudinal axis, and a disengageable latch able to move between an engaged position, in which the chamber placed in the locked position is integral in movement with the breech head, and a retracted position in which said chamber is released in rotation relative to the breech head, the linear and rotary actuators being configured to obtain combined linear and rotational movements of the breech head.

The disengageable latch allows the chamber to be extracted from the breechblock by moving back and rotating the breech head. The combined linear and rotational movements of the breech head enable the breech head to be screwed into the chamber and the chamber to be screwed into the breechblock. Similarly, the combined linear and rotational movements of the breech head, as well as the movement of the disengageable latch, enable the chamber to be unscrewed from the breechblock and then the breech head to be unscrewed from the chamber.

Preferably, the linear actuator includes a guide member, in particular in the form of a pair of axial rods, integral with the breech support and slidably mounted in the breechblock, said guide member being driven in translation by a translation drive member, in particular a cylinder or a geared motor, supported by the breechblock.

Preferably, the rotary actuator includes a rotary coupling member integral in movement with the breech head and mounted freely rotatable relative to the breech support, said rotary coupling member being driven in rotation by a rotary drive member, in particular a geared motor, integral with the recoiling mass.

The internal and external threads may each include several threads.

The presence of several threads means quicker screwing/unscrewing and better sealing.

Advantageously, the breechblock includes a deformable seal positioned against the rear end of the barrel and configured to be compressed between the front end of a chamber in the locked position and the rear end of the barrel.

Such a deformable seal provides a tight seal at the front of the chamber.

Advantageously, each loading chamber defines a breech head receiving space extending from the rear end of the chamber to an ammunition receiving space, the breech head receiving space having a first cross-section and the ammunition receiving space having a second cross-section that is smaller than the first cross-section.

In this way, the junction area between the breech head receiving space and the ammunition receiving space has a shoulder that limits the insertion of the breech head into the chamber and ensures a good sealing at the rear of the chamber when the breech head closes off the rear of the chamber.

In particular, the internal thread provided at the rear end of each chamber extends from the rear end of the chamber to the rear end of the chamber's ammunition receiving space, the diameter of the internal thread being greater than the diameter of the ammunition receiving space. In this way, when the breech head and chamber are in the locked position, the base of a round of ammunition received in the receiving space is compressed between the breech head and chamber. This compression of the base ensures that the chamber is sealed at the rear.

To better illustrate the subject matter of the present invention, a particular embodiment will be described below, with reference to the appended drawings. In these drawings:

FIG. 1 is a perspective view of the large-caliber gun according to the present invention;

FIG. 2 is a cutaway view of the gun shown in FIG. 1;

FIG. 3 is a top view of the gun according to the present invention, illustrating the step of reloading the chambers placed in a feeding position;

FIG. 4 is a top view of the gun illustrating the step of positioning a reloaded chamber in the firing position;

FIG. 5 is a side view of the gun, in longitudinal section, illustrating the step of moving the breech head and chamber placed in the firing position to a locked position;

FIG. 6 is a top view of the gun illustrating the locking step, with one of the chambers in the locked position;

FIG. 7 is a side view, in longitudinal section, of the gun shown in FIG. 6;

FIG. 8 is a top view of the gun illustrating the firing step; and

FIG. 9 is a side view of the gun, in longitudinal section, illustrating the step of unlocking the chamber after the round of ammunition has been fired.

Referring first to FIG. 1, it can be seen that the large-caliber gun according to the present invention includes, in a manner known per se, a cradle 1 and a recoiling mass 2.

The cradle 1 is a non-recoiling part of the gun. The function of the cradle 1 is to support and guide the recoiling mass 2.

The recoiling mass 2 refers to all the components of the gun that recoil during firing. Typically, the recoiling mass 2 is connected to the cradle 1 by one or more firing brakes (not shown) and one or more recuperators (not shown), which allow the recoiling mass 2 to be returned to action after firing. In particular, the recoiling mass 2 includes a barrel 3 and a breech assembly 4.

The barrel 3 has a longitudinal axis X0, a front end 3*a* and a rear end 3*b*. By the term "front" is meant the end located towards the front of the gun, i.e. the side of the gun from which the rounds of ammunition are fired, and by the term "rear" the end located in the opposite direction.

As can be seen from FIGS. 1 and 2, the breech assembly 4 includes a breechblock 5, a breech support 6, a breech head 7, a plurality of loading chambers 8, a chamber moving mechanism 9 and a locking mechanism 10.

The breechblock 5 is a parallelepipedic block with a front face 5*a* on the barrel 3 side and an opposite rear face 5*b*. As can be seen from FIGS. 5, 7 and 9, the breechblock 5 has a front bore 50 complementary to the rear end region 3*b* of the barrel 3 and extending from its front face 5*a* to a rear bore 51. The rear bore 51 extends from the rear face 5*b* of the breechblock 5 to the front bore 50 and is coaxial with the front bore 50. The rear end region 3*b* of the barrel 3 is received in the front bore 50, so that the rear bore 51 opens out into the barrel 3. The rear bore 51 has an internal thread and is able to receive a front end region 8*a* of a loading chamber 8.

The breech support 6 is mounted so as to be axially slidable relative to the breechblock 5. To this end, the breech support 6 includes two axial rods 60 connected to each other, at their rear ends, by a support part 61. Each axial rod 60 is received in a corresponding through-bore 52, 53 provided in the breechblock 5. In particular, the breechblock 5 has an upper through-bore 52 and a lower through-bore 53 provided on either side of the front 50 and rear 51 bores. In this way, the axial rods 60 of the breech support 6 pass through the breechblock 5, with their front ends free on the barrel 3 side.

The breech head 7 is supported by the support part 61 of the breech support 6 and is rotatably mounted relative to it. The function of the breech head 7 is to close off the rear end 8*b* of a chamber 8 ready for firing. In the preferred embodiment of the present invention, the breech head 7 is a screw breech head. The screw breech head 7 takes the form of a cylindrical body 70 provided with an external thread extending from the front end to the rear end of the cylindrical body 70. The breech head 7 carries a disengageable latch 71 in the form of a finger 71. The finger 71 is mounted so as to be movable between an engaged position, in which the finger 71 projects radially outwards from the breech head 7, beyond the side wall of the cylindrical body 70, and a retracted position, in which the finger 71 is fully housed in a corresponding recess, of complementary shape, provided in the side wall of the cylindrical body 70.

The plurality of loading chambers 8 are each intended to hold one round of ammunition. In the embodiment shown, the breech assembly 4 includes three loading chambers 8. It should however be emphasized that the number of chambers is not limited to three. Each chamber 8 is in the form of a tube opened at both ends thereof. Each chamber 8 is positioned in the breech assembly 4 in such a way that the longitudinal axis X1 of the chamber 8 is coaxial or parallel to the longitudinal axis X0 of the barrel 3. As can be seen from FIGS. 2, 5, 7 and 9, each chamber 8 defines within it a breech head receiving space 8*c* and an ammunition receiving space 8*d*. The breech head receiving space 8*c* is a rear end region of chamber 8 extending from the rear end 8*b* to the ammunition receiving space 8*d*. The ammunition receiving space 8*d* extends from the front end 8*a* to the breech head receiving space 8*c*. The breech head receiving space 8*c* has a first cross-section and the ammunition receiving space 8*d* has a second cross-section that is smaller than the first cross-section. Thus, a shoulder is formed between the breech head receiving space 8*c* and the ammunition receiving space 8*d*. The front end region 8*a* of each chamber 8 has an external thread able to cooperate with the internal thread of the rear bore 51 of the breechblock 5. Each chamber 8 also has an internal thread provided on the inner tubular wall of the breech head receiving space 8*c*. This internal thread is intended to cooperate with the external thread of the breech head 7. The tubular wall of the breech head receiving space 8*c* has a recess 80 complementary to the disengageable latch 71 and able to receive the disengageable latch 71 in the engaged position.

The mechanism 9 for moving the chambers 8 makes it possible to move the chambers 8 in translation with their axes X1 parallel to the longitudinal axis X0 of the barrel 3. In other words, the mechanism 9 for moving the chambers 8 makes it possible to move the chambers 8 transversely with respect to the longitudinal direction of the barrel 3 and the breechblock 5. In particular, this movement mechanism 9 is able to move each chamber 8 in translation between a feeding position, in which the chamber 8 can be reloaded with a round of ammunition via the rear end 8*b* thereof, and a firing position, in which the chamber 8 is in alignment with the barrel 3 and is located between the breechblock 5 and the breech head 7. The mechanism 9 for moving the chambers 8 includes a drawer 90 and a translation actuator 91.

The drawer 90 is able to mechanically support the plurality of chambers 8. To this end, the drawer 90 includes a body defining housings 92 each shaped to receive part of a loading chamber 8. In the embodiment shown, with the breech assembly 4 including three loading chambers 8, the drawer 90 includes three axial through housings 92. It should be emphasized that the number of housings 92 defined in the drawer 90 is not limited to three housings and is equal to the number of loading chambers 8. As each chamber 8 is in the form of a tube, each housing 92 is also in the form of a tubular housing. The internal diameter of the tubular housing 92 is slightly greater than the external diameter of the chamber 8, at the cross-section of the chamber 8 intended to be received in the housing 92, so that there is a clearance between the chamber 8 and the housing 92. The cross-section of the chamber 8 received in the housing 92 is substantially the central cross-section of the chamber 8. In other words, the length of the chamber 8 protruding from the front of the housing 92 and the length of the chamber 8 protruding from the rear of the housing 92 are the same. The three housings 92 are arranged one after the other in the body of the drawer 90, their axes lying substantially in the same plane passing through the longitudinal axis X0 of the barrel 3. Alternatively, the body of the drawer 90 could be curved in the shape of an arc of a circle, in which case the housings 92 are arranged side by side with their axes parallel to one another but in different planes passing through the longitudinal axis X0.

The drawer 90 is supported by the cradle 1, behind the breechblock 5, and is mounted so as to be movable in translation relative to the latter. To this end, the cradle 1 includes a support case 11 to which the body of the drawer 90 is connected and in which the drawer 90 is mounted so as to be movable in translation. This support case 11 is positioned between the rear face 5*b* of the breechblock 5 and the support part 61 of the breech support 6. The support case 11 includes an upper flange 11*a* and a lower flange 11*b* arranged in alignment with the upper 5*c* and lower 5*d* faces, respectively, of the breechblock 5 and extending on either side of the drawer 90. These flanges 11*a*, 11*b* have, on their faces opposite to each other, a slide-forming part (not visible) able to cooperate with a complementary sliding part 93 of the body of the drawer 90. In this way, the drawer 90 is guided in translation between the upper 11*a* and lower 11*b* flanges of the support case 11. The flanges 11*a*, 11*b* also each have a through-hole to receive the axial rods 60 of the breech support 6. In this way, the support case 11 guides both the translational movement of the drawer 90, and hence of the chambers 8, transversely to the longitudinal direction of the barrel 3, and the axial translational movement of the breech support 6, and hence of the breech head 7, in the longitudinal direction of the barrel 3.

The cradle 1 also includes two stop cases 12 on either side of the breechblock 5, secured to the support case 11. Each stop case 12 includes two opposing stops 12*a*, 12*b*, namely a front axial translation stop 12*a* and a rear axial translation stop 12*b*, and a reinforcing element 12*c* extending between the two opposite stops 12*a*, 12*b*. These front 12*a* and rear 12*b* stops are arranged to be in close proximity to the front 8*a* and rear 8*b* ends, respectively, of each chamber 8 placed in the feeding position and are configured to leave the opening at the rear end 8*b* of each chamber 8 free. In particular, each rear stop 12*b* is in the form of a wall perpendicular to the longitudinal axis X0 of the barrel 3, which wall is pierced by a loading aperture configured to allow the passage of a round of ammunition but to prevent the passage of a chamber 8 therethrough. Each front stop 12*a* is in the form of a wall parallel to the wall of the rear stop 12*b* and arranged opposite the corresponding rear stop 12*b*. The reinforcing element 12*c* is in the form of a wall connecting the front stop 12*a* and rear stop 12*b* at their lower clamp-side edge 11*b* and configured to allow passage of the drawer 90 and the chambers 8.

Alternatively, these front and rear stops could be replaced by any suitable immobilization means enabling an axial immobilization of the chambers in the feeding position during recoil. For example, such immobilization means could include cams or retractable fingers.

The translation actuator 91 is connected to the drawer 90 to move the drawer 90 in translation relative to the cradle 1, in particular along the support case 11, in a translation direction transverse to the longitudinal axis X0. In the embodiment shown, this actuator 91 is a motorized actuator. The motorized actuator 91 includes an electric motor, in particular a geared motor, secured to the cradle, in particular to the lower clamp 11*b* of the support case 11. Preferably, this motor is coupled to the drawer 90 with a rack-and-pinion linkage (not visible). Such a linkage enables a rotary movement of the motor shaft to be converted into a translational movement of the drawer 90, reliably and without obstructing the space behind the breechblock 5.

The locking mechanism 10 is configured to move the breech head 7 and the chamber 8 placed in the firing position, between an unlocked position and a locked position. In the unlocked position, the breech head 7 is positioned behind the chamber 8 placed in the firing position. In the locked position, the breech head 7 is received in the breech head receiving space 8*c* of the chamber 8, thus closing off the rear of the chamber 8, and the front end region 8*a* of the chamber 8 is received in the rear bore 51 of the breechblock 5, and thus opens out into the barrel 3.

In the preferred embodiment of the invention, the locking mechanism 10 is a screw locking mechanism. This mechanism 10 includes a linear actuator and a rotary actuator that are configured to obtain combined linear and rotational movements of the breech head 7, as well as the disengageable latch 71 secured to the breech head 7.

The linear actuator makes it possible to move the breech support 6 linearly relative to the breechblock 5 along the longitudinal axis X0 of the barrel 3. This actuator includes the pair of axial rods 60 of the breech support 6, constituting a guide member, and a translation drive member for the axial rods 60. The translation drive member may be a cylinder or a geared motor (not shown) supported by the breechblock 5.

The rotary actuator makes it possible to rotate the breech head 7 relative to the breech support 6 about the longitudinal axis X0 of the barrel 3. This actuator includes a rotary coupling member 13 and a rotary drive member 14 for this coupling member 13. The coupling member 13 is in the form of a bell including a circular disk 13*a* carrying at its center a shaft 13*b* whose axis is perpendicular to the plane of the disk 13*a*. The shaft 13*b* is integral in rotation with the breech head 7. In particular, the shaft 13*b* is received, with an interference fit, in a central recess that opens out at the rear end of the breech head 7. The circular disk 13*a* is mounted so as to be freely rotatable relative to the breech support 6. In particular, the circular disk 13*a* is mounted so as to be rotatable relative to the support part 61. The rotary drive member 14 may be a geared motor secured to the recoiling mass 2. In particular, the geared motor 14 is secured to the support part 61 of the breech support 6. Thus, when the geared motor 14 rotates the bell 13 relative to the breech support 6, the breech head 7 is also rotated relative to the breech support 6, about the longitudinal axis X0 of the barrel 3.

Thus, the breech assembly 4 according to the present invention has a compact structure and makes it possible to align, guide and lock chambers, previously loaded with ammunition, in the tube to enable firing.

The operating procedure for the large-caliber gun described above is as shown in FIGS. 3 to 9.

At the start of a firing sequence, the breech assembly 4 is in the configuration shown in FIG. 3. In this configuration, two chambers 8 are in the feeding position and are ready to receive a new round of ammunition via their rear end 8*b*. These two chambers 8 can be reloaded simultaneously by any suitable means, by manual, automatic or semi-automatic reloading.

Then, as can be seen in FIG. 4, the chamber 8 containing the selected round of ammunition is aligned with the barrel 3, and thus in the firing position, by lateral translation of the drawer 90 by means of the translation actuator 91.

Once the desired chamber 8 has been placed in the firing position, the locking mechanism 10 is actuated, as shown in FIG. 5. In particular, the linear actuator and the rotary actuator are actuated to translate and rotate the breech head 7 towards the chamber 8. This allows the breech head 7 to be screwed into the breech head receiving space 8*c* of the chamber 8, and then the threaded front end region 8*a* of the chamber 8 to be screwed into the rear bore 51 of the breechblock 5. During these combined movements, the breech head 7 is advanced by the distance A while being rotated, until the breech head 7 comes into abutment against the shoulder formed at the front end of the internal thread of the chamber 8. This shoulder is arranged in such a way that when the breech head 7 abuts against the shoulder, it compresses the base of the round of ammunition received in the chamber 8. Once the breech head 7 has been screwed into the chamber 8, the chamber 8 and the breech head 7 secured to it are in turn advanced and rotated by the distance B, until the chamber 8 comes into abutment against the rear end 3*b* of the barrel 3. Advantageously, a deformable seal 54 is positioned between the rear bore 51 and the front bore 50 of the breechblock 5, so that when the chamber 8 is screwed into the breechblock 5, the seal 54 is compressed between the front end 8*a* of the chamber 8 and the rear end 3*b* of the barrel 3.

As can be seen from FIGS. 6 and 7, this screwing action locks together the various components of the recoiling mass 2, namely the barrel 3, the breechblock 5, the chamber 8 ready for firing, the breech head 7 and the breech support 6. The round of ammunition contained in the thus-locked chamber 8 can then be fired.

The internal and external threads of the breech head 7, chambers 8 and breechblock 5 are preferably multi-threaded. Such threads are resistant to wear, are load bearing and allow large feed.

As can be seen in FIG. 8, the firing of the round of ammunition causes the recoiling mass 2 to recoil, and in particular, the axial sliding of the chamber 8 locked in the drawer 90. The other chambers 8, in the feeding position, are axially immobilized during recoil by the front and rear stops 12*a* and 12*b* of the cradle 1.

After the gun has been returned to action, the recoiling mass 2 is unlocked, as shown in FIG. 9. To do this, the breech head 7 is retracted backwards while being rotated. During this unscrewing movement of the breech head 7, the disengageable latch 71 moves from its retracted position to its engaged position, making the chamber 8 integral with the breech head 7. Therefore, in the engaged position of the latch 71, the combined retracting and rotating movements of the breech head 7 cause the chamber 8 to unscrew from the breechblock 5. Once the chamber 8 has been extracted from the rear bore 51 of the breechblock 5, the breech head 7 is in turn unscrewed from the chamber 8, after the latch 71 has moved into the retracted position, thus freeing the chamber 8.

Once the chamber 8 in firing position has been moved to the unlocked position, the drawer 90 can again be moved transversely to bring into firing position a new chamber 8 containing a round of ammunition. The above locking and firing steps can be repeated immediately after a previous round of ammunition has been fired. At the same time as this new firing sequence, the chambers 8 placed in the feeding position and found to be empty after firing can be reloaded.

Therefore, to fire a first burst, the procedure is to insert a round of ammunition into the or each empty chamber 8 in the feeding position, move the drawer 90 in translation to bring one of the chambers 8 into the firing position, then place said chamber 8 in the locked position, notably by a screwing action. The shot can then be fired, and simple unscrewing, translation and screwing movements are repeated for subsequent shots. The empty chambers 8 are loaded with ammunition in masked time, while another round of ammunition is being fired, so that the firing rate is high.

It is understood that the particular embodiment just described is indicative and non-limiting, and that modifications may be made without departing from the scope of the present invention.

The invention claimed is:

1. A large-caliber gun including a cradle and a recoiling mass mounted so as to be movable relative to the cradle, the recoiling mass including a barrel having a longitudinal axis and a breech assembly, the breech assembly including a breechblock secured to the barrel, a breech support movable in axial translation relative to the breechblock and coupled to a breech head, wherein the breech assembly further includes:

a plurality of loading chambers each intended to receive a round of ammunition, a mechanism for moving the chambers and configured to support the chambers and successively place one of the chambers in a firing position, namely between the breechblock and the breech head and in alignment with the longitudinal axis of the barrel, and at least one other chamber in a feeding position, in which the at least one chamber is able to receive a round of ammunition via a rear end of the at least one chamber, and a locking mechanism configured to move the breech head and the chamber placed in the firing position, between an unlocked position and a locked position, wherein in the locked position the chamber is closed off at the rear end thereof by the breech head and opens out at a frond end thereof into the barrel, the locking mechanism being further configured to move both the breech head and the chamber placed in the firing position to the locked position by a movement of the breech head.

2. The large-caliber gun according to claim 1, wherein the mechanism for moving the chambers is supported by the cradle and includes a drawer able to mechanically support the plurality of chambers arranged side by side and parallel to the longitudinal axis, and a translation actuator connected to the drawer to move the drawer in translation relative to the cradle in a translation direction transverse to the longitudinal axis.

3. The large-caliber gun according to claim 2, wherein the translation actuator is a motorized actuator including an electric or hydraulic motor, coupled to the drawer by a rack-and-pinion linkage.

4. The large-caliber gun according to claim 2, wherein the drawer includes a plurality of axial through housings, each axial through housing being shaped to receive a loading chamber with a clearance between the chamber and the housing, the cradle including axial translation stops, integral with the cradle, arranged to be in proximity to the front and rear ends of each chamber placed in the feeding position and configured to leave an opening at the rear end of each chamber free.

5. The large-caliber gun according to claim 1, wherein the breech head is a screw breech head having an external thread able to cooperate with a corresponding internal thread provided at the rear end of each chamber, each chamber having an external thread at the front end thereof, the external thread being able to cooperate with a corresponding internal thread provided in the breechblock, the locking mechanism being a screw locking mechanism having:

a linear actuator connected to the breech support for linearly moving the breech support relative to the breechblock along the longitudinal axis, a rotary actuator connected to the breech head to rotate the breech head relative to the breech support about the longitudinal axis, and a disengageable latch able to move between an engaged position, in which the chamber placed in the locked position is integral in movement with the breech head, and a retracted position in which the chamber is released in rotation relative to the breech head, wherein the linear and rotary actuators are configured to obtain combined linear and rotational movements of the breech head.

6. The large-caliber gun according to claim 5, wherein the linear actuator includes a guide member integral with the breech support and slidably mounted in the breechblock, the guide member being driven in translation by a translation drive member supported by the breechblock.

7. The large-caliber gun according to claim 5, wherein the rotary actuator includes a rotary coupling member integral in movement with the breech head and mounted freely rotatable relative to the breech support, the rotary coupling member being driven in rotation by a rotary drive member integral with the recoiling mass.

8. The large-caliber gun according to claim 5, wherein the internal and external threads each include several threads.

9. The large-caliber gun according to claim 1, wherein the breechblock includes a deformable seal positioned against the rear end of the barrel and configured to be compressed between the front end of a chamber in the locked position and the rear end of the barrel.

10. The large-caliber gun according to claim 1, wherein each loading chamber defines a breech head receiving space extending from the rear end of the chamber to an ammunition receiving space, the breech head receiving space having a first cross-section and the ammunition receiving space having a second cross-section that is smaller than the first cross-section.

* * * * *